US009512641B2

(12) United States Patent
Delande et al.

(10) Patent No.: US 9,512,641 B2
(45) Date of Patent: Dec. 6, 2016

(54) KEY HAVING A RETRACTABLE INSERT AND CORRESPONDING DEPLOYMENT MODULE

(71) Applicant: VALEO SECURITE HABITACLE, Créteil (FR)

(72) Inventors: Benoît Delande, Créteil (FR); Karim Namar, Créteil (FR)

(73) Assignee: VALEO SECURITE HABITACLE, Créteil (FR)

( * ) Notice: Subject to any disclaimer, the term of this patent is extended or adjusted under 35 U.S.C. 154(b) by 0 days.

(21) Appl. No.: 14/366,280

(22) PCT Filed: Dec. 21, 2012

(86) PCT No.: PCT/EP2012/076826

§ 371 (c)(1),
(2) Date: Jun. 18, 2014

(87) PCT Pub. No.: WO2013/093088

PCT Pub. Date: Jun. 27, 2013

(65) Prior Publication Data

US 2014/0360236 A1 Dec. 11, 2014

(30) Foreign Application Priority Data

Dec. 23, 2011 (FR) ..... 11 04063

(51) Int. Cl.
*A44B 15/00* (2006.01)
*E05B 19/00* (2006.01)
(Continued)

(52) U.S. Cl.
CPC ..... *E05B 19/0082* (2013.01); *E05B 19/043* (2013.01); *E05B 19/00* (2013.01);
(Continued)

(58) Field of Classification Search
CPC .... E05B 19/04; E05B 19/0082; E05B 19/043; E05B 19/046; E05B 19/00; E05B 19/0017; E05B 19/18; E05B 27/0003; E05B 27/0021; Y10T 70/7791; Y10T 70/8676; Y10T 70/7876; Y10T 70/7808; Y10T 70/7825; Y10T 7/5889; Y10T 70/7814; Y10T 70/791; Y10T 70/1391
(Continued)

(56) References Cited

U.S. PATENT DOCUMENTS 2,822,684 A * 2/1958 Ray ..... 70/456 R
4,252,006 A * 2/1981 Swisher ..... 70/34
(Continued)

FOREIGN PATENT DOCUMENTS

WO 2010/023293 A1 3/2010
WO 2010/023294 A1 3/2010

OTHER PUBLICATIONS

International Search Report for corresponding International Application No. PCT/EP2012/076826, mailed Feb. 6, 2013 (2 pages).
(Continued)

*Primary Examiner* — Suzanne Barrett
*Assistant Examiner* — Morgan McClure
(74) *Attorney, Agent, or Firm* — Osha Liang LLP

(57) ABSTRACT

The present invention relates to a key (1), in particular for a motor vehicle, comprising: —a housing (3), —an insert (5, 7) mounted pivotally about a pivoting axis (A) and comprising a key-bit support (5) and a key bit (7), —a mechanism for deploying the insert (5, 7) mounted in said housing (3) and comprising: • a push button (19) axially received in a housing (21), and • an elastic return element (23) for the insert (5, 7), wherein a first end (23*a*) is connected to the insert (5, 7) at the support (5), said support (5) or said button
(Continued)

Figure 1A:
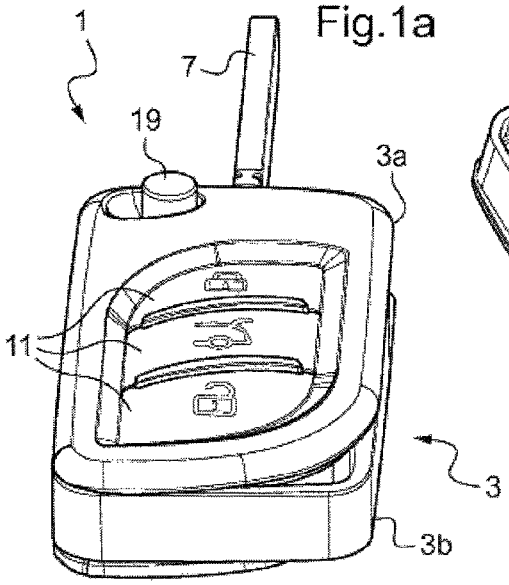

(19) comprising two retaining lugs (39) ascending parallel to the pivoting axis (A) and positioned facing each other and symmetric relative to said pivoting axis (A), said retaining lugs (39) defining, on each side of the pivoting axis (A), a space (50) for the angular displacement of the first end (23*a*) or of the second end (23*b*) according to an angle of between 10° and 90°.

6 Claims, 3 Drawing Sheets

(51) Int. Cl.
*E05B 19/04* (2006.01)
*E05B 27/00* (2006.01)

(52) U.S. Cl.
CPC ..... *E05B 19/04* (2013.01); *E05B 19/046* (2013.01); *E05B 27/0003* (2013.01); *Y10T 70/5889* (2015.04); *Y10T 70/7791* (2015.04); *Y10T 70/7808* (2015.04); *Y10T 70/7814* (2015.04); *Y10T 70/7825* (2015.04); *Y10T 70/7876* (2015.04); *Y10T 70/791* (2015.04); *Y10T 70/8676* (2015.04)

(58) Field of Classification Search
USPC ..... 70/395–399, 408, 456 R, 459
See application file for complete search history.

(56) References Cited

U.S. PATENT DOCUMENTS

| | | | | |
|---|---|---|---|---|
| 4,888,970 | A * | 12/1989 | Kinzler et al. | 70/456 R |
| 5,765,417 | A * | 6/1998 | Bolton | 70/495 |
| 5,943,889 | A * | 8/1999 | Chiu | 70/456 R |
| 6,058,751 | A * | 5/2000 | Dimig et al. | 70/419 |
| 6,691,539 | B2 * | 2/2004 | Jacob et al. | 70/408 |
| 6,705,141 | B1 * | 3/2004 | Jacob et al. | 70/408 |
| 7,127,922 | B2 * | 10/2006 | Khounsombath et al. | 70/456 R |
| 7,370,501 | B2 * | 5/2008 | Miyata et al. | 70/395 |
| 7,895,865 | B2 * | 3/2011 | Hartman et al. | 70/1.5 |
| 8,225,633 | B2 * | 7/2012 | Luo et al. | 70/456 R |
| 8,266,936 | B2 * | 9/2012 | Box et al. | 70/408 |
| 8,479,546 | B2 * | 7/2013 | Delande et al. | 70/456 R |
| 8,763,434 | B2 * | 7/2014 | David et al. | 70/456 R |
| 8,820,130 | B2 * | 9/2014 | Delande | 70/456 R |
| 2003/0177798 | A1 * | 9/2003 | Chodosh | 70/456 R |
| 2009/0217722 | A1 | 9/2009 | Luo et al. | |
| 2013/0091909 | A1 * | 4/2013 | Lai | 70/379 R |

OTHER PUBLICATIONS

Search Report for corresponding French Application No. 1104063, mailed Oct. 3, 2012 (2 pages).

* cited by examiner

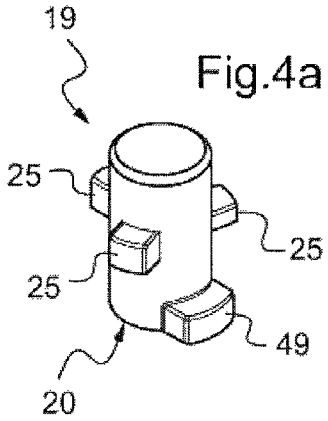
Fig.4a
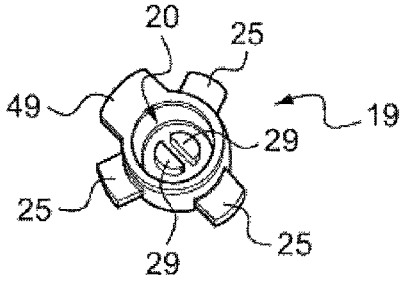
Fig.4b
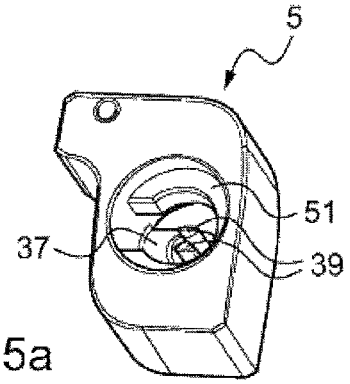
Fig.5a
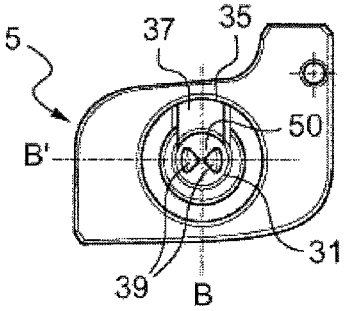
Fig.5b
Fig.5c
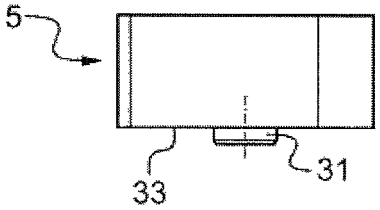
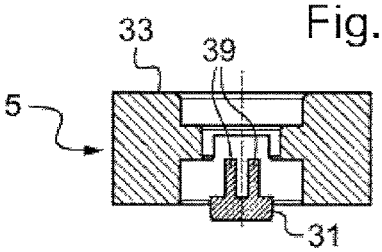
Fig.5d
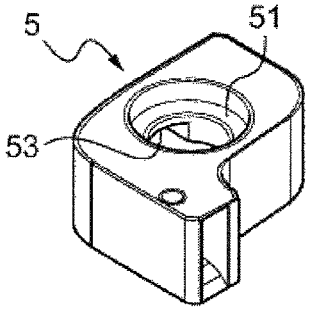
Fig.5e

KEY HAVING A RETRACTABLE INSERT AND CORRESPONDING DEPLOYMENT MODULE

The present invention relates to keys, in particular for a motor vehicle, the body of which has a casing and that part of which that comprises the key bit, known as the insert, is retractable into the casing.

The invention also concerns a deployment module for the insert of such a key.

Key structures that form a casing with a mechanical retractable insert, wherein the insert is mounted in a pivotable manner between a rest position, in which the insert is retracted into a housing inside the casing, and a use position, in which the insert is deployed with respect to the casing, have already been proposed.

Such an articulation of the insert requires an insert deployment mechanism mounted in the casing.

International application WO2010023294 shows such a mechanism. Said document shows in particular a deployment mechanism mounted between an upper half-shell that forms a cover and a lower half-shell that forms a casing bottom, having:

- a push button housed axially in an associated housing of the upper half-shell and protruding from this upper half-shell in order to be actuated by a user, said push button being connected to the insert and having a means for preventing movement with respect to the casing, allowing the insert to be prevented from moving in the rest position and in the use position, and
- an insert elastic return element for urging said insert into a pivoting movement toward its use position when the push button is actuated.

When the user actuates the push button, the connection between the push button and the insert is broken, thereby allowing the latter to pivot toward its use position since nothing impedes its rotation any more under the effect of the rotation force to which it is subjected by the elastic return element.

In order to pass the insert back into the rest position, it then suffices for the user to actuate the push button, releasing the movement-prevention element and enabling the pivoting movements of the insert. The user then has to impart on the insert a force counter to that of the elastic return element, which tends to keep the insert in the use position.

In this kind of mechanism, the return element is generally provided with two ends. A first end is fixed to the insert, said end being inserted between two first, parallel lips, and a the second end is fixed to the push button, being inserted between two second, parallel lips.

However, this kind of mounting necessitates the use of return elements that have their first and second ends aligned in one and the same plane with a positioning tolerance between these ends of around plus or minus 5°. Thus, this restriction makes it necessary to have return elements of which the specifications are more restrictive and can thus lead to additional costs.

One of the aims of the invention is thus to at least partially remedy the drawbacks of the prior art and to propose a key having a retractable insert, of which the specifications are less restrictive.

Thus, the subject of the invention concerns a key, in particular for a motor vehicle, having:

- a casing having an upper half-shell that forms a cover and a lower half-shell that forms a casing bottom,

- an insert mounted in a pivotable manner about a pivot axis and comprising a key-bit support and a key bit secured to the support,
- an insert deployment mechanism mounted in said casing and comprising:
  - a push button housed axially in an associated housing of the upper half-shell and protruding from this upper half-shell in order to be actuated by a user, and
  - an insert elastic return element of which a first end is connected to the insert at the support, for urging said insert into a pivoting movement toward a use position when the push button is actuated, said return element being fixed to the push button by a second end, said support or said button having two holding pegs that rise parallel to the pivot axis and are positioned in a manner facing one another and symmetrically with respect to said pivot axis, said holding pegs defining, on either side of the pivot axis, a space for angular travel of the first end or the second end of the elastic return element at an angle of between 10° and 90°.

According to one aspect of the invention, the holding pegs have a triangular footprint and in that the angle of the space for angular travel is 90°.

According to another aspect of the invention, the push button has a hollow internal space inside which the second end of the return element fits.

According to another aspect of the invention, the support has a hollow stud to which the first end is fixed.

According to another aspect of the invention, that end of the return element that is opposite the one housed by the holding pegs is housed by two parallel lips that are formed in the bottom of the push button or on the support.

According to another aspect of the invention, the return element is a helical spring.

The invention also concerns a deployment module for an insert for a key having a retractable insert designed to be mounted in a casing of said key, having

- an insert mounted in a pivotable manner about a pivot axis and comprising a key-bit support and a key bit secured to said support,
- a push button housed in an orifice of said support, and
- an insert elastic return element fixed on one side to said support and on the other side to the push button, said support or said button having two holding pegs that rise parallel to the pivot axis and are positioned in a manner facing one another and symmetrically with respect to said pivot axis, said holding pegs defining, on either side of the pivot axis, a space for angular travel of the first end or the second end of the elastic return element at an angle of between 10° and 90°.

Figure 1B:
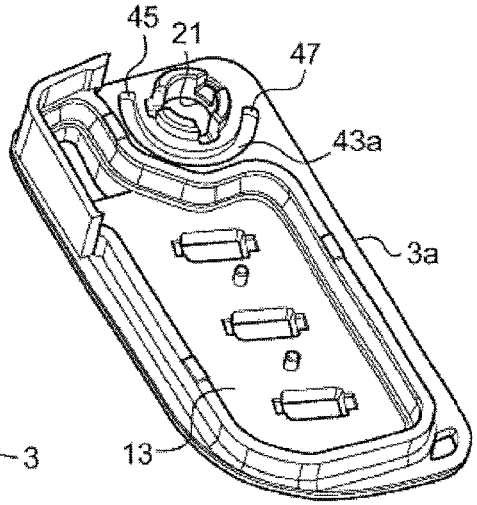
Figure 1C:
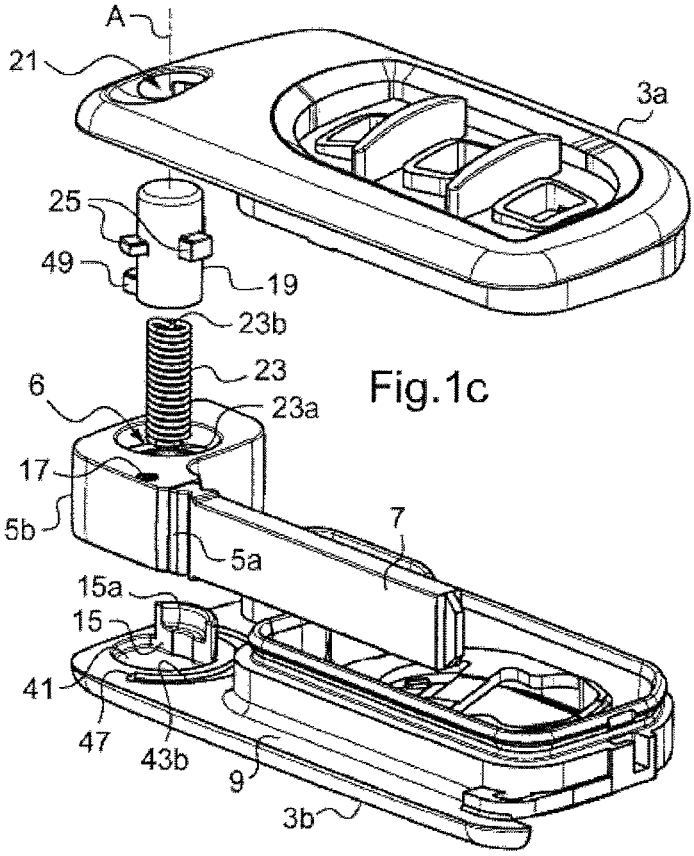
Figure 1D:
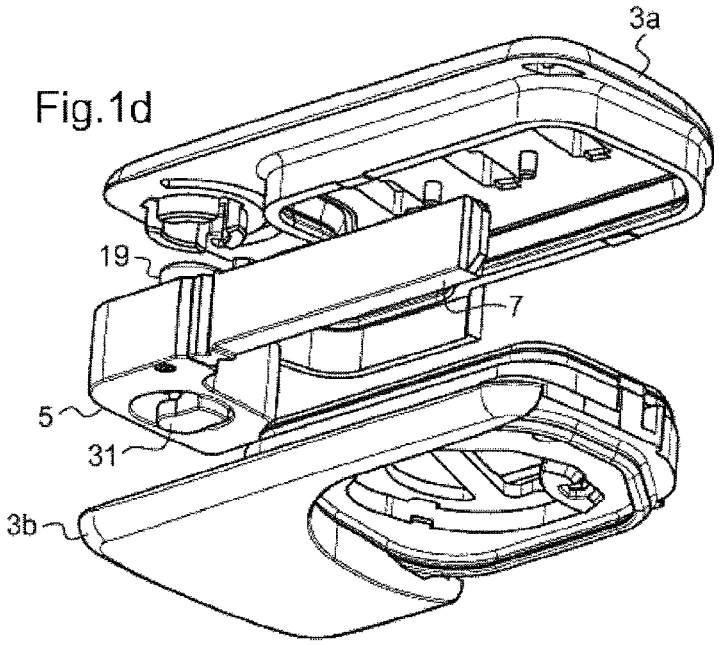
Figure 2:
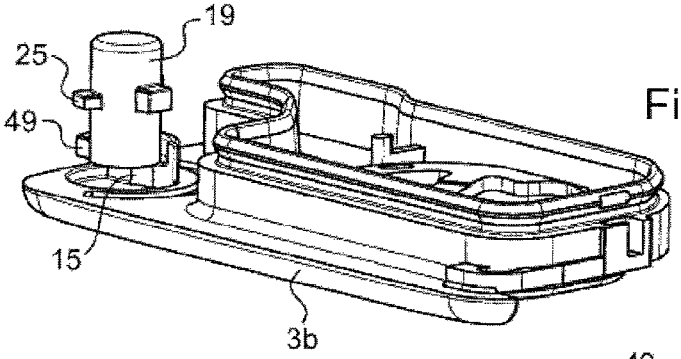
Figure 3A:
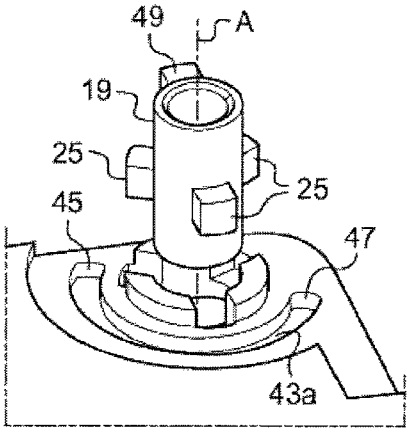
Figure 3B:
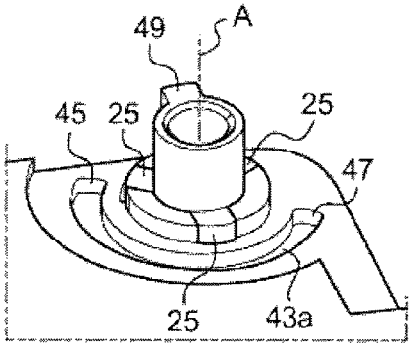

Further features and advantages of the invention will become more clearly apparent from reading the following description, given by way of nonlimiting illustration, and from the appended drawings, in which:

FIG. 1*a* shows a key according to the invention,

FIG. 1*b* shows the upper half-shell of the casing of the key from FIG. 1*a*, FIG. 1*c* shows an exploded view of the key from FIG. 1*a*, FIG. 1*d* is a perspective bottom view of FIG. 1*c*, FIG. 2 is a more detailed view of the lower half-shell and the push button of the key from FIG. 1*a*, FIG. 3*a* shows an exploded view of a push button and a housing of the push button on the upper half-shell of the casing of the key from FIG. 1*a*, FIG. 3*b* is a view of the push button mounted in the housing from FIG. 3*a*, FIG. 4*a* shows a push button for the key from FIG. 1*a*, FIG. 4*b* is a bottom view of the push button from FIG. 4*a*, FIG. 5*a* shows a key-bit support for the key from FIG. 1*a*, FIG. 5*b* is a top view of the key-bit support from FIG. 5*a*, FIG. 5*c* is a side view of the key-bit support from FIG. 5*a*, FIG. 5*d* is a cross-sectional view of the key-bit support from FIG. 5*c*, and FIG. 5*e* is a partial side view of the key-bit support from FIG. 5*a*.

The key 1 shown in FIGS. 1*a* to 1*d* has:

a casing 3 forming a key bow, an insert 5, 7 comprising a key-bit support 5 and a key bit 7 secured to the support 5, and a deployment mechanism for deploying the insert 5, 7 with respect to the casing 3 so as to allow the insert 5, 7 to move between:

a rest position (FIGS. 1*c*, 1*d*) in which the insert 5, 7 is retracted into the casing 3 in a setback 9 provided inside the casing 3, for example in an approximate L shape corresponding to the shape of the insert 5, 7, and a use position (FIG. 1*a*) in which the insert 5, 7 is deployed with respect to the casing 3 so that it can be inserted into a lock.

In the example illustrated, the casing 3 is produced in two parts in the form of an upper half-shell 3*a* that forms a cover and a lower half-shell 3*b* that forms a casing bottom, it being possible for these two half-shells 3*a*, 3*b* to be joined together for example by clip-fastening. A seal (not shown) may be disposed between the two half-shells 3*a*, 3*b* in order to protect the inside of the casing 3 from the outside environment, in particular from moisture or dust. A decorative band (not shown) may also be provided between the two half-shells 3*a*, 3*b* in order to make the assembly more attractive.

The key 1 may also combine a mechanical key with an electronic key. In this case, an electronic printed circuit board (not shown) is disposed in the casing 3. This board carries the electronic remote-control circuits for the central locking/unlocking of the vehicle doors, and also a transponder (not shown) for the vehicle antitheft system and a battery (not shown) to power the remote-control function. This remote-control function is actuated by the operator via actuating buttons 11 provided on the upper half-shell 3*a*. A cover 13 may be disposed in the casing 3 in order to conceal the electric or electronic components of the remote-control casing 3.

Furthermore, the support 5 has two opposite ends 5*a*, 5*b*, of which the end 5*a* carries the key bit 7. To this end, one end 7*a* of the key bit 7 may be fitted into a complementary housing (not shown) in the end 5*a* of the support 5. The support 5/key bit 7 assembly is kept fixed together for example by a pin (not shown) that passes through holes 17 made in the support 5 and the key bit 7. Of course, the key bit 7 may be fixed to the support 5 by any other appropriate means.

Moreover, the insert 5, 7 deployment mechanism comprises:

a push button 19 housed in an associated housing 21 of the upper half-shell 3*a* and passing through an orifice 6 in the support 5, the push button 19 protruding from the upper half-shell 3*a* so as to be accessible to a user so that he can actuate this push button 19 in order to deploy the insert 5, 7, and an elastic return element 23 fixed by a first end 23*a* to the insert 5, 7 and by a second end 23*b* to an element that is prevented from rotating with respect to the casing 3, for urging the insert 5, 7 into a pivoting movement toward the use position when the push button 19 is actuated. This return element 23 is for example a helical torsion spring.

When the push button 19 is actuated by the user, the push button 19 is made to move in axial translation along the longitudinal axis A within the support 5.

In order to prevent the push button 19 from coming into abutment against the end wall of the support 5 at the end of its travel, a stop means for the push button 19 may be provided. This stop means may comprise a stop pad which is formed in the support 5 and with which the push button 19 comes into contact at the end of its travel, such that the translational movement of the push button 19 is stopped before the latter reaches the end wall of the support 5.

In the embodiment illustrated in FIGS. 1*c*, 1*d* and 2, the support 5 has in its bottom a cavity (FIG. 1*d*), for example in a circular arc extending over more than 180°, and the stop means comprises a stop pad 15 (FIGS. 1*c* and 2) that is formed in one piece with the lower half-shell 3*b* and is inserted into the support 5 at this circular arc. This stop pad 15 also has a setback for defining a surface 15*a* for contact with the push button 19 at the end of its travel. Moreover, the push button 19 has a movement-prevention means for preventing the push button from rotating with respect to the casing 3. This movement-prevention means forms a guide for the push button 19 in its axial translational movement along the longitudinal axis A of the push button 19 and is made in one piece with the push button 19.

Thus, it is the push button 19 that triggers the deployment mechanism, guides the push button 19 in translational movement, and prevents the push button 19 from rotating.

In the example illustrated, this guide-forming movement-prevention means comprises at least one guide peg 25 which projects outward from the outer surface of the push button 19. Provision can be made for the push button 19 to have two diametrically opposite guide pegs 25 or else three guide pegs 25 that are distributed regularly for optimal guidance in translational movement.

With reference to FIGS. 3*a* and 3*b*, each guide peg 25 cooperates with a corresponding slot 27 provided in the housing 21 on the upper half-shell 3*a* in order to guide the push button 19 in translational movement with respect to the casing 3 along the axis A and to prevent the push button 19 from rotating with respect to the casing 3.

For its part, the return element 23 is fixed by its second end 23*b* to the push button 19 that is thus stable in terms of rotation (FIG. 1*c*) without requiring an intermediate part between the push button 19 and the return element 23 of the deployment mechanism.

To this end, as can be seen in FIGS. 4*a* and 4*b*, the push button 19 has a hollow internal space 20 for housing the second end 23*b* of the return element 23.

More precisely, two parallel lips 29 are formed in the bottom of the push button 19 and extend toward the second end 23*b* of the return element 23 in order to house this second end 23*b*. In this case, the second end 23*b* extends in return inside the return element 23. The lips 29 thus prevent the second end 23*b* from moving with respect to the push button 19 and thus prevent the second end 23*b* from rotating with respect to the upper half-shell 3*a* of the housing 3.

Moreover, in order to urge the insert 5, 7 into a pivoting movement, the return element 23 is preferably fixed by its first end 23*a* to the support 5.

For this purpose, as can be seen from FIGS. 5*a*, 5*b*, the support 5 may have a hollow stud 31 for housing the first end 23*a* of the return element 23 at the end wall 33 of the support 5. This stud 31 is for example connected to an inner side wall 35 of the support 5 by a radial bridge of material 37 and can be made in one piece therewith.

At the stud 31, the support 5 may have a first axis B and a second axis B' that are perpendicular to one another, the first axis B being parallel to the axis of the key bit 7, and are located in a plane perpendicular to the pivot axis A, the point of intersection of the first and second axes B and B' being located on the axis A. Said support 5 may have two holding pegs 39 that rise parallel to the pivot axis A and are positioned on the second B' in a manner facing one another and symmetrically with respect to the first axis B and to the pivot axis A. The first end 23*a* of the return element 23 is positioned between said holding pegs 39 during assembly of the key 1. Said holding pegs 39 define, on either side of the pivot axis A and the second axis B', a space 50 for angular travel of the first end 23*a* at an angle of travel between 10° and 90°.

In the example shown in FIG. 5*b*, the holding elements 39 have a triangular shape, with, on either side of the pivot axis A, a space 50 for angular travel having an angle of 45° on each side of the first axis B, or a total angle of travel of 90°.

On account of these two spaces 50 for angular travel, it is possible to use return element 23 that have a positioning tolerance between these two ends 23*a* and 23*b* that is at least equal to half the angle of travel. For example, this positioning tolerance may be plus or minus 45° when the spaces 50 for angular travel have an angle of travel of 90°.

However, it is possible to imagine another embodiment (not shown) where the holding pegs 39 are carried by the button 19 and where the lips 29 are positioned on the support 5, for example on the hollow stud 31. Thus, the angular travel 50 in this embodiment would be for the second end 23*b*.

Moreover, as illustrated in FIGS. 5*c*, 5*d*, the stud 31 emerges from the end wall 33 of the support 5. Thus, an orifice 41 (FIG. 1*c*) is provided on the inner wall of the lower half-shell 3*b* at the setback 9 for the stud 31 to be fitted into while the support 5 is being mounted in the casing 3.

As described above (see FIGS. 1*c*, 1*d*), the support 5 is open at its bottom in a circular arc, into which the pad 15 is introduced while the support 5 is being mounted on the lower half-shell 3*b*. This circular arc is centered on the pivot axis A such that, as the support 5 pivots, the stop pad 15 moves along in this circular arc until the radial bridge of material 37 comes into abutment against this stop pad 15, thus preventing the pivoting movement of the support 5.

In addition, in order to guide the pivoting movement of the support 5, the support 5 may also have two guide fingers (not shown) on either side of the second end 5*b*, these guide fingers, under the effect of the actuation of the push button 19, being guided respectively by a first guide groove 43*a* formed in the upper half-shell 3*a* and by a second guide groove 43*b* formed in the lower half-shell 3*b* (see FIGS. 1*b* and 1*c*). These guide grooves 43*a*, 43*b* have a semicircular overall shape and are each delimited by two stops 45, 47. Thus, when the guide fingers are bearing against the stops 45, the insert 5, 7 is in the rest position, and when the guide fingers are bearing against the stops 47, the insert 5, 7 is in the use position.

Of course, any other means for guiding the pivoting movement of the support 5 can be used.

Furthermore, the push button 19 and the support 5, which are respectively fixed to the return element 23, cooperate in order to keep the insert 5, 7 in the rest position.

To this end, with reference to FIGS. 4*a*, 4*b* and 5*b*, 5*e*, the push button 19 has at least one holding projection 49 for keeping the insert 5, 7 in the rest position, and the support 5 has a collar 51. This collar 51 is open to allow the holding projection 49 to pass through and has a notch 53 that cooperates with the holding projection 49 such that the holding projection 49 engages in the notch 53 in the rest position and frees the notch 53 when the push button 19 is actuated, so as to allow the support 5 to pivot.

The assembly comprising the support 5, the key bit 7, the push button 19 and the return element 23 forms an insert 5, 7 deployment module. This deployment module is assembled independently of the casing 3.

The assembly of this deployment module has the following steps (see FIGS. 1*c*, 4*a*, 4*b* and 5*a*):

- the end 7*a* of the key bit 7 is fixed to the end 5*a* of the support 5,
- the return element 23 is introduced through the orifice 6 in the support 5,
- the first end 23*a* of the return element 23 is fixed between the holding pegs 39 of the hollow stud 31 of the support 5,
- the push button 19 is introduced through the orifice 6 and the push button 19 is positioned such that the holding projection 49 of the push button 19 is presented above the opening in the collar 51 of the support 5,
- the second end 23*b* of the return element 23 is fixed in the lips 29 in the internal space 20 of the push button 19, and
- the holding projection 49 is introduced into the opening in the collar 51 of the support 5 and the push button 19 is turned through a predefined angle such that the holding projection 49 engages in the notch 53 in the collar 51 of the support 5. The predefined angle is for example 90° for a quarter-turn mounting or 180° for a half-turn mounting.

Moreover, when the return element 23 is a helical torsion spring, the rotation of the push button 19 until the holding projection 49 engages in the notch 53 makes it possible to easily preload the torsion spring.

Of course, the order of some steps in the assembly of this deployment module may be changed.

With the deployment module thus assembled, it can be mounted in the casing 3. To this end, the support 5 is mounted on the lower half-shell 3*b* and the upper half-shell 3*a* is positioned in such a way that the push button 19 is housed in the housing 21 of the upper half-shell 3*a*, protruding from the casing 3. The two half-shells 3*a*, 3*b* are then fixed together.

Thus, when an operator wishes to use the insert 5, 7 and thus to deploy it from the casing 3, he presses the push button 19, the actuation of which frees the notch 53 in the support 5, thereby relaxing the return element 23.

Under the action of the return element 23, the support 5 pivots with respect to the housing 3, the guide fingers of the support 5 being guided by the guide grooves 43*a*, 43*b* provided on the casing 3.

Under the effect of the pivoting of the support 5, the key bit 7 is disengaged from the setback 9 and then passes from its retracted position in the casing 3 to its deployed position with respect to the casing 3, in which the key bit 7 can be used, moving for example through an angle of 180°.

This use position is reached when the guide fingers of the support 5 bear against the stops 47 of the casing 3, thereby preventing any additional movement.

Thus, it can be clearly seen that, by virtue of the spaces for travel between the holding pegs for holding the first end of the return element, it is possible to use return elements having a positioning tolerance between the two ends thereof of between 5° and 45°, thereby making it possible to reduce the restrictions of the specifications and thus to reduce the production costs.

The invention claimed is:

1. A key for a motor vehicle, comprising:

a casing having an upper half-shell that forms a cover and a lower half-shell that forms a casing bottom;

an insert mounted in a pivotable manner about a pivot axis and comprising a key-bit support and a key bit secured to the support;

an insert deployment mechanism mounted in said casing and comprising:

a push button housed axially in an associated housing of the upper half-shell and protruding from this upper half-shell in order to be actuated by a user, and an elastic return element comprising: a first end that is connected to the insert at the support via two parallel lips at the bottom of the push button, for urging said insert into a pivoting movement toward a use position when the push button is actuated, and a second end positioned between two holding pegs of the support which define, on either side of the pivot axis, a space for angular travel of the second end of the elastic return element at an angle of between 10° and 90°, wherein the space for angular travel between the two holding pegs holding the second end of the elastic return element is larger than a space between the two parallel lips in the push button which house the first end of the elastic return element, so as to facilitate the insertion of the second end into the space between the two holding pegs after insertion of the first end into the parallel lips.

2. The key as claimed in claim 1, wherein the two holding pegs have a triangular footprint and the angle or the space for angular travel is 90°.

3. The key as claimed in claim 1, wherein the elastic return element is a helical spring.

4. The key as claimed in claim 1, wherein the push button has a hollow internal space inside which the first end of the elastic return element fits.

5. The key as claimed in claim 4, wherein the support has a hollow stud to which the second end is fixed.

6. A deployment module for an insert for a key having a retractable insert designed to be mounted in a casing of said key, the module comprising:

the insert mounted in a pivotable manner about a pivot axis and comprising a key-bit support and a key bit secured to said support;

an insert deployment mechanism mounted in said casing and comprising:

a push button housed axially in an associated housing of an upper half-shell of the casing and protruding from this upper half-shell in order to be actuated by a user, and an elastic return element comprising: a first end that is connected to the insert at the support via two parallel lips at the bottom of the push button, for urging said insert into a pivoting movement toward a use position when the push button is actuated, and a second end positioned between two holding pegs for support which define, on either side of the pivot axis, a space for angular travel of the second end of the elastic return element at an angle of between 10° and 90°, wherein the space for annular travel between the two holding pegs holding the second end of the elastic return element is larger than a space between the two parallel lips in the push button which house the first end of the elastic return element, so as to facilitate the insertion of the second end into the space between the two holding pegs after insertion of the first end into the parallel lips.

* * * * *